US009038834B2

(12) United States Patent
Liu

(10) Patent No.: US 9,038,834 B2
(45) Date of Patent: May 26, 2015

(54) SHELVING STRUCTURE

(71) Applicant: Jung-Hua Liu, Changhua (TW)

(72) Inventor: Jung-Hua Liu, Changhua (TW)

(73) Assignee: SUN YU TA Co. Ltd., Changhua (TW)

( * ) Notice: Subject to any disclaimer, the term of this patent is extended or adjusted under 35 U.S.C. 154(b) by 0 days.

(21) Appl. No.: 14/050,011

(22) Filed: Oct. 9, 2013

(65) Prior Publication Data

US 2015/0096954 A1 Apr. 9, 2015

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 73/00*** | (2006.01) |
| ***A47B 87/02*** | (2006.01) |
| ***A47F 5/10*** | (2006.01) |

(Continued)

(52) U.S. Cl.

CPC ..... *A47B 47/0066* (2013.01); *A47B 47/0016* (2013.01); *A47B 47/0091* (2013.01); *A47B 87/02* (2013.01); *A47B 73/00* (2013.01); *A47B 73/006* (2013.01); *A47B 87/0276* (2013.01); *A47B 47/0025* (2013.01); *A47B 47/00* (2013.01); *A47F 5/10* (2013.01); *A47F 7/281* (2013.01); *A47B 96/02* (2013.01); *A47B 47/0075* (2013.01)

(58) Field of Classification Search

CPC ..... A47B 47/0066; A47B 47/0091; A47B 47/0016; A47B 47/042; A47B 47/0041; A47B 47/00; A47B 47/0008; A47B 47/0025; A47B 47/0033; A47B 47/005; A47B 47/0075; A47B 47/021; A47B 47/03; A47B 47/05; A47B 47/0261; A47B 47/0269; A47B 73/00; A47B 73/006; A47B 87/0276; A47B 87/02; A47B 87/0284; A47B 87/00; A47B 87/0207; A47B 96/00; A47B 96/02; A47B 95/00; A47B 57/00; A47F 7/281; A47F 7/28; A47F 7/283; A47F 5/10; A47F 5/108; A47F 7/0007; A47F 7/0021; A47F 7/0028; E04B 2001/1927; E04B 1/1906; E04B 1/1903; E04B 1/2403; E04B 2/14; E04B 2/04; E04B 2/60

USPC ..... 211/186, 182, 74, 188, 194, 189; 256/25, 27; 403/170, 171, 176, 217, 403/218; 52/284, 780, 291, 282.1, 282.3, 52/DIG. 10; 312/265.5, 265.6, 257.1, 263

See application file for complete search history.

(56) References Cited

U.S. PATENT DOCUMENTS 3,081,023 A * 3/1963 Taylor ..... 232/24
3,144,881 A * 8/1964 Sproull ..... 138/117

(Continued)

*Primary Examiner* — Jennifer E Novosad

(74) *Attorney, Agent, or Firm* — Che-Yang Chen; Law Office of Michael Chen

(57) ABSTRACT

A shelving structure may include a predetermined number of shelf boards, rear plates, connecting members, and frame members. The shelf board is a rectangular board with two expanded side edges. The rear plate is a hexagonal plate with corners modified into arc-shaped inward recesses and with U-shaped slots extending inwards in the middle of the recesses. The U-shaped slot has continuous undulating bounding edges on both of its sides. The connecting member has two clamping planes linked by a base. The frame member has three equally distributed holding slots extending through both ends. Each outer surface between two neighboring holding slots of the connecting member has a recessed strip with regularly spaced extension plates for installing additional components. The shelving structure can be readily installed or uninstalled and can be modified or rearranged according to space restraint or other requirements.

4 Claims, 9 Drawing Sheets

(51) Int. Cl.
*A47F 7/28* (2006.01)
*A47B 96/02* (2006.01)

(56) References Cited

U.S. PATENT DOCUMENTS 3,722,704 A * 3/1973 Piretti ..... 211/183
D236,411 S * 8/1975 Horney ..... D7/708
4,023,681 A * 5/1977 Plant ..... 211/74
4,095,858 A * 6/1978 Hopf ..... 312/198
4,247,011 A * 1/1981 Walter ..... 211/194
4,422,555 A * 12/1983 Jacobs ..... 211/74
4,567,989 A * 2/1986 Hurst, Jr. ..... 211/74
4,658,560 A * 4/1987 Beaulieu ..... 52/646
D292,657 S * 11/1987 Wightman ..... D6/462
4,715,503 A * 12/1987 Johnson ..... 211/74
D312,362 S * 11/1990 Wightman ..... D7/701
4,969,568 A * 11/1990 Yoshida ..... 220/4.33
5,096,073 A * 3/1992 O'Brien ..... 211/163
5,529,423 A * 6/1996 Burke et al. ..... 403/218
5,947,305 A * 9/1999 Lin ..... 211/74
6,062,402 A * 5/2000 Ford ..... 211/189
6,283,564 B1 * 9/2001 Corson ..... 312/223.2
6,595,378 B2 * 7/2003 Wang ..... 211/189
7,604,133 B2 * 10/2009 Tsai ..... 211/194
7,963,404 B2 * 6/2011 Shang ..... 211/36
8,248,792 B2 * 8/2012 Wei ..... 361/692
2002/0005512 A1 * 1/2002 Trill ..... 256/25
2006/0278777 A1 * 12/2006 Atkinson et al. ..... 248/188.4
2012/0256148 A1 * 10/2012 Sirotin et al. ..... 256/25
2013/0341295 A1 * 12/2013 Dixon ..... 211/74

* cited by examiner

SHELVING STRUCTURE

FIELD OF INVENTION

The present invention relates to a shelving structure, more particularly to a simple shelving structure that can be readily and rapidly installed.

BACKGROUND OF THE INVENTION

Current shelving structures are usually manufactured by welding or screw locks to integrate metal frames and then by installing a bearing plate between or onto the metal frames. This integrated structure is stable however since it usually occupies a certain space and cannot be uninstalled, it thus is inconvenient for handling and transportation. In addition, storing these products also requires large storage space. Furthermore, since they cannot be uninstalled or rearranged into different shapes, these integrated shelving structures might not be useful if the space available for them has to be changed.

Therefore, it has been an objective of research and development for related industries to overcome the above-mentioned shortcomings of the current shelving structures. The present invention describes a further improved structure that can easily and rapidly installed or uninstalled, which solves the above-mentioned problems of the current shelving structures.

SUMMARY OF THE PRESENT INVENTION

Current metal frame-based shelving structures that are integrated by welding or screw locks have technical problems. These shelving structures usually occupy large storage space and cannot be installed or uninstalled. The shelving structure of the present invention provides solutions to these technical problems.

The present invention provides an improved shelving structure, which comprises a predetermined number of shelf boards, rear plates, connecting members and frame members. The shelf board is a rectangular plate, with its size predetermined based on the types of goods to be placed into the shelving structure, therefore allowing the shelving structure to be flexible in its size, as well as the depth and volume of the holding space. Two side edges of the shelf board are expanded in arc shape and form a stopper portion. The rear plate is a hexagonal plate with its corners modified into arc-shaped inward recesses and with U-shaped slots extending inwards in the middle of the inward recesses. The U-shaped slot has continuous undulating bounding edges on both of its sides. The connecting member has two clamping planes, with the proper interval maintained between these two planes by the connecting base that links these two clamping planes. One of the clamping planes has two bulged ribs located at the inner surface on opposite sides of the connecting base, and both planes have bulged areas located at the central part of their outer surfaces for convenient hand grasping. The frame member has three equally distributed holding slots extending through both ends of the connecting member and the end portions of these holding slots are expanded for locking the expanded side edges of the shelf boards. There is a long strip of recessed portion located at the center of each of the outer surfaces between two neighboring holding slots of the connecting member, with extension plates installed in these recessed portions. The extension plates are regularly spaced and extending outwards perpendicular to the frame member for installing additional components. The above is a brief description of the shelving structure of the present invention.

Advantages of the shelving structure described in the present invention over current shelving structures include:

(i) The shelving structure of the present invention can be readily uninstalled when not being used, which not only allows convenient handling and transportation, but also dramatically saves storage space.

(ii) The shelving structure of the present invention can be conveniently installed without sorting to any tools. In addition, installing this shelving structure does not involve use of any screws since its use usually slows down the process of installation.

(iii) The building components of the shelving structure of the present invention, the shelf board and the frame member, can be used for constructing shelving structures of various shapes or combinations, based on available space or for certain specific visual effects. This feature allows flexible use or rearrangement of the shelving structure.

(iv) The shelving structure of the present invention can be rearranged into other shapes or forms by modifying the connections among the connecting members, shelf boards, and bearing boards, thereby allowing the use of this shelving structure for multiple purposes.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
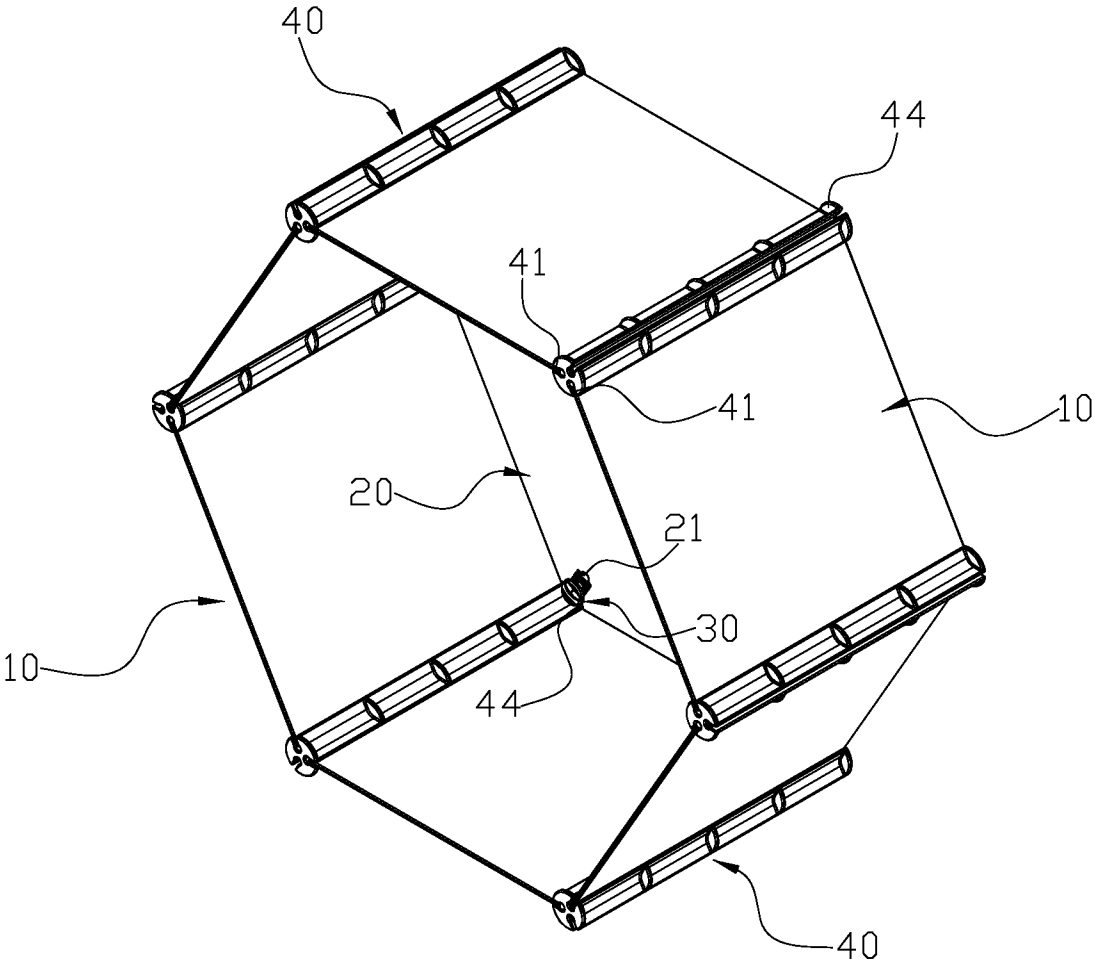
FIG. 1 is a three-dimensional combinational view of the first embodiment of the shelving structure of the present invention.
Figure 2:
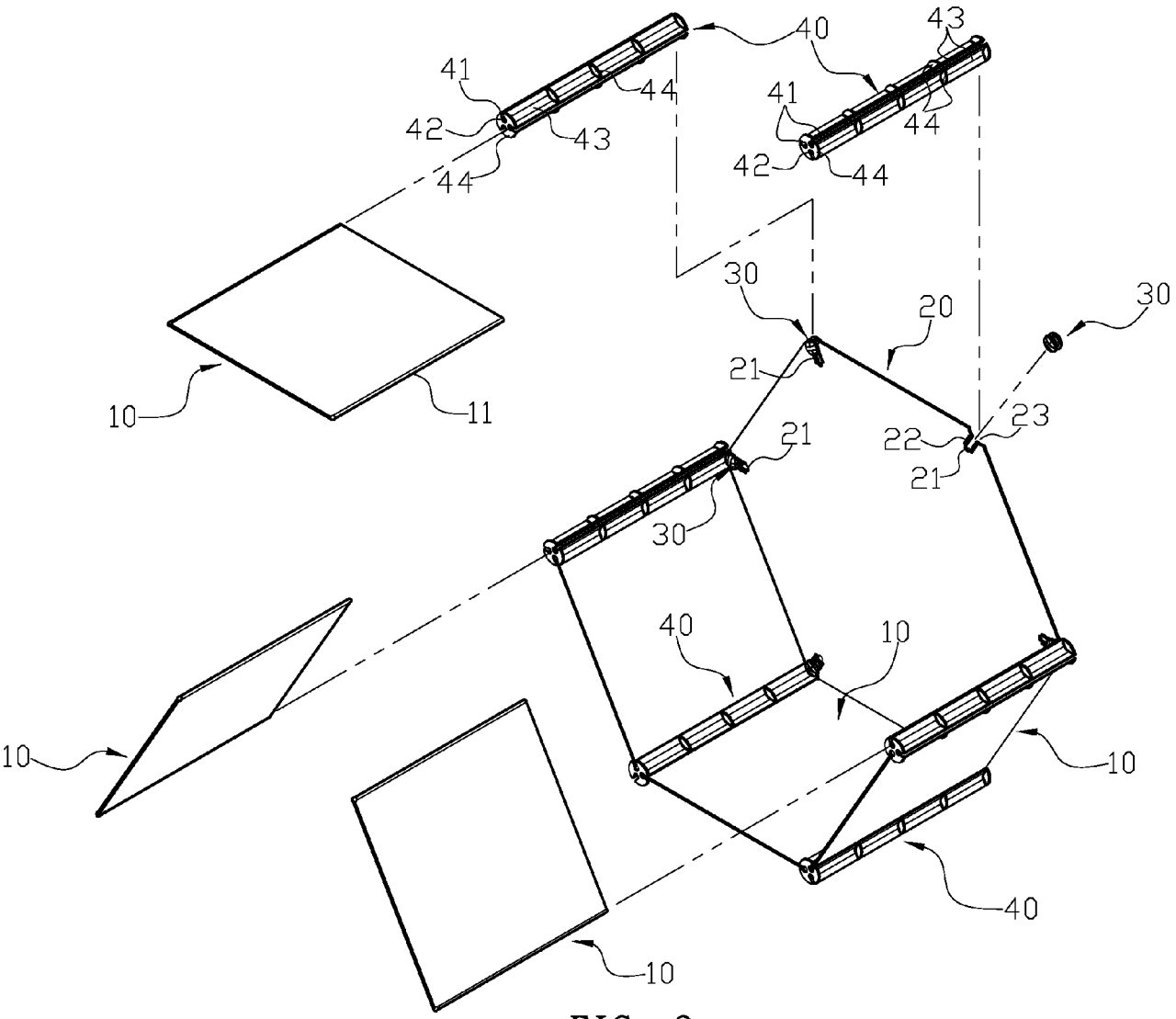
FIG. 2 is an exploded perspective view of the first embodiment of the shelving structure of the present invention.
Figure 4:
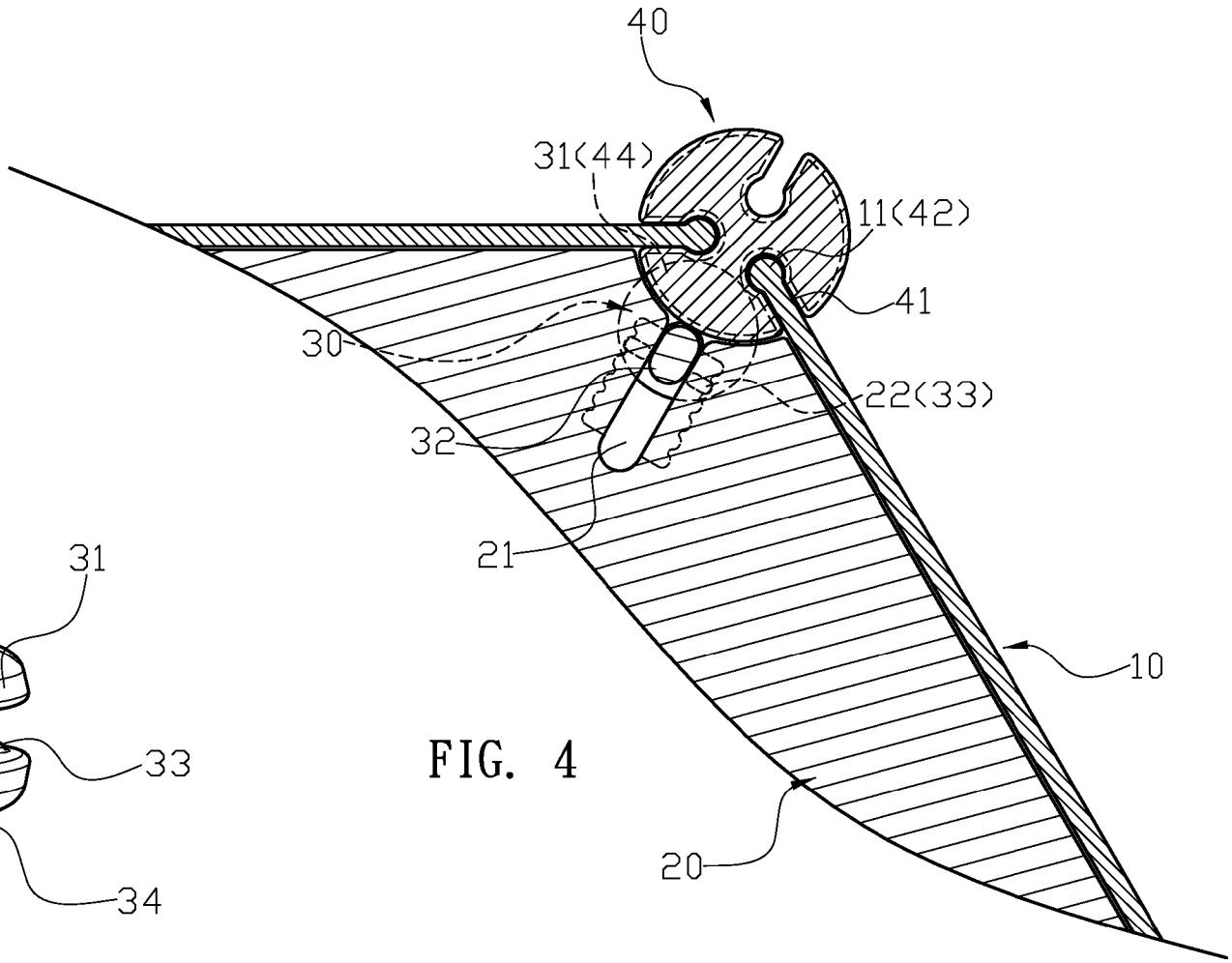
FIG. 4 is a sectional view of the first embodiment of the shelving structure of the present invention.
Figure 3:
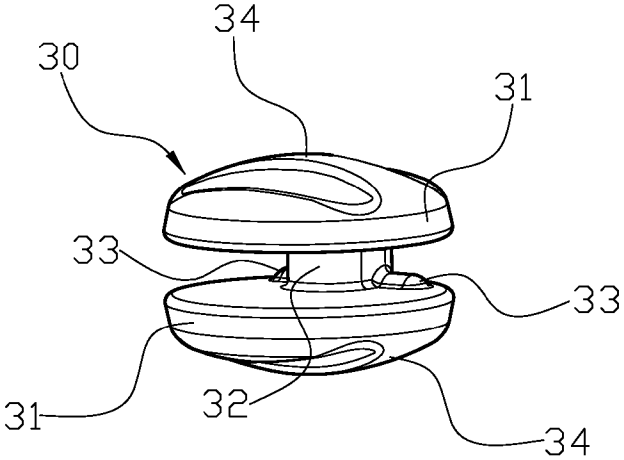
FIG. 3 is an enlarged view of the connecting member of the first embodiment of the shelving structure of the present invention.
Figure 6:
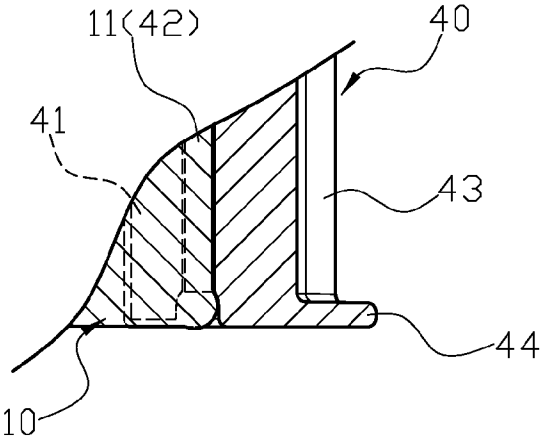
FIG. 6 is another sectional view the first embodiment of the shelving structure of the present invention.
Figure 5:
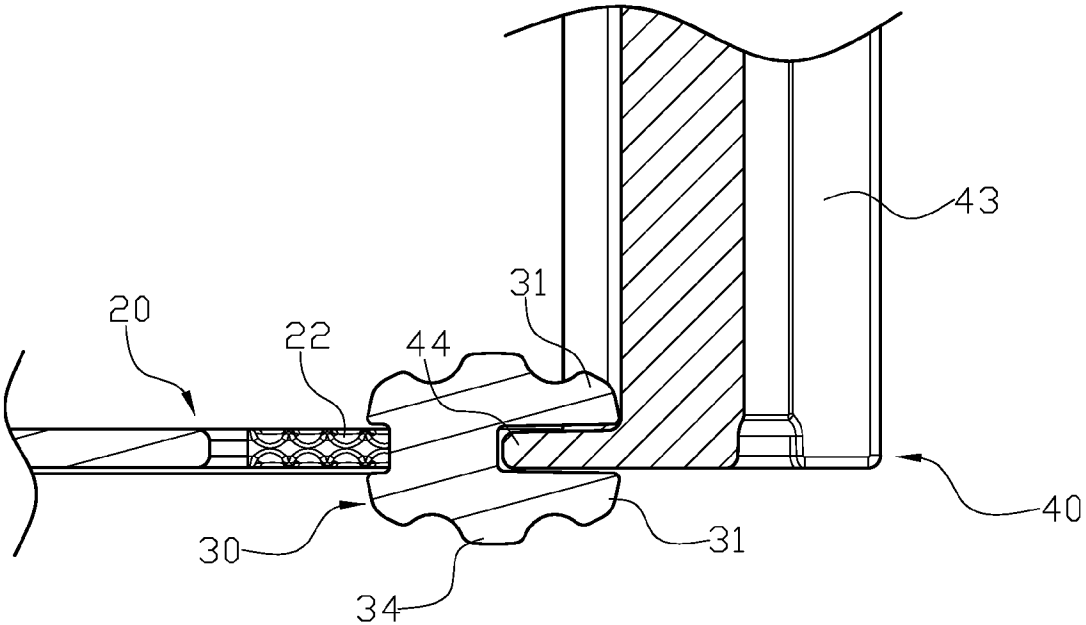
FIG. 5 is another sectional view the first embodiment of the shelving structure of the present invention.

A specific embodiment of the shelving structure of the present invention is shown in FIGS. 1-3. The shelving structure comprises a predetermined number of shelf boards (10), rear plates (20), connecting members (30) and frame members (40). The shelf board (10) is a rectangular board and its size is predetermined to allow different size, depth and volume of the shelving structure for storing different items. Both sides of the shelf board (10) that connect to the frame members (40) have arc-shaped expanded edges, which act as stopper portions (11) for stable connection to the frame members (40). The rear plate (20) is a hexagonal plate with U-shaped slots (21) extending inwards at its corners. The U-shaped slot has continuous undulating bounding edges (22) on both of its sides. The corners of the rear plate (20) are modified into arc-shaped inward recesses (23). The connecting member (30) has two clamping planes (31) with proper interval between these planes maintained by a connecting base (32) that links these two planes. One of the planes has two bulged ribs (33) located on the inner surface and at opposite sides of the connecting base (32). Both planes have bulged areas (34) located at the central part of the outer surfaces for convenient hand grasping. The frame member (40) has three equally distributed holding slots (41) extending through both ends of the frame member (40) and the end portions (42) of these holding slots are expanded for securely locking the stopper portions (11) of the shelf boards (10). Each outer surface between two neighboring holding slots (41) of the connecting member (30) has a long strip of recessed portion (43), with extension plates (44) regularly spaced and extending outwards perpendicular to the frame member (40) for installing additional components.

The installation of the shelving structure of the prevent invention is illustrated in FIGS. 1, 4, 5 and 6. The connecting base (32) of a connecting member (30) is slide into the U-shaped slot (21) of the rear plate (22) with the bulged ribs (33) engaged with the bounding edges (22) of the U-shaped slots, thereby fastening the connecting member (30) to the rear plate (22) and achieving a secure connection between these two components. The frame member (40) is then placed against the arc-shaped recess (23) of the rear plate (20), and the extension plate (44) of the frame member (40) is interposed between the clamping planes (31) of the connecting member (30). In this way all of the six frame members (40) can be integrated with the rear plate (20). The shelf boards (10) are then installed by interposing the stopper portions (11), the expanded side edges of the shelf board (10), into the holding slots (41) of the frame members (40). This simple process of installation generates a hexagonal shelving structure comprising the shelf boards (10), the rear plate, the connecting members (30) and the frame members (30). In addition, the stopper portion (11) of the shelf board (10) is locked into the expanded end portions (42) of the frame member (40), which provides a significantly increased strength of connection and structural stability.

Figure 7:
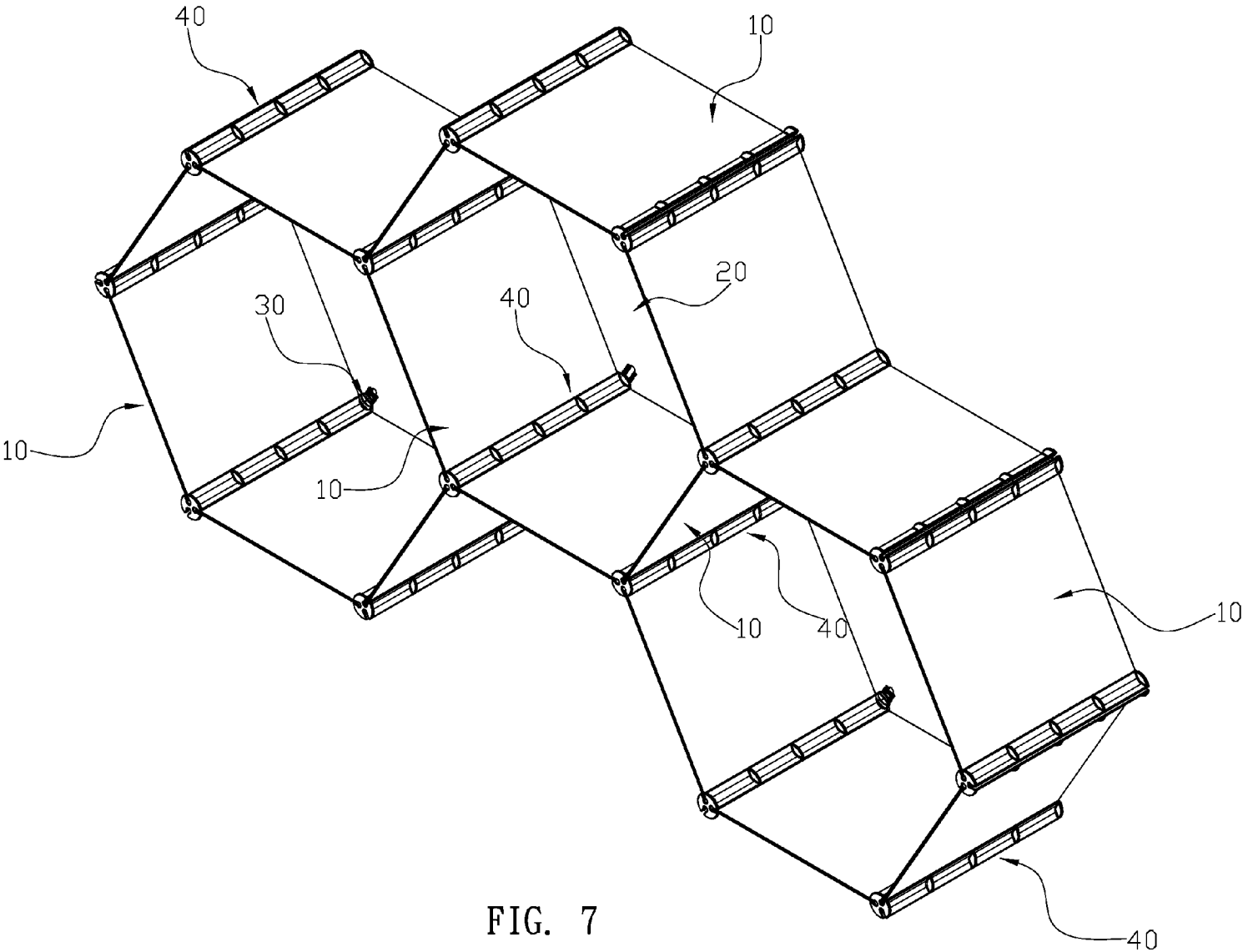
FIG. 7 is a diagram showing the various possible shapes or combinations of the first embodiment of the shelving structure of the present invention.

In practical use, as shown in FIG. 7, the shelving structure of the present invention can be placed onto any flat surfaces with the support of the frame members (40). The shelf boards (10) and rear plate (20) together provide a storage space. As the shelving structure can be readily expanded, it allows storage of multiple units in an organized manner. In addition, the shelving structure can be uninstalled and the components such as shelf boards (10) and frame members (40) can be reused to redesign or rearrange the shelving structure into different shapes or forms, which allows flexible use or rearrangement of the shelving structure based on the available space or the requirement of environment. Therefore, the use of the shelving structure of the present invention may not be restricted by the modifications or changes of the available space.

Figure 8:
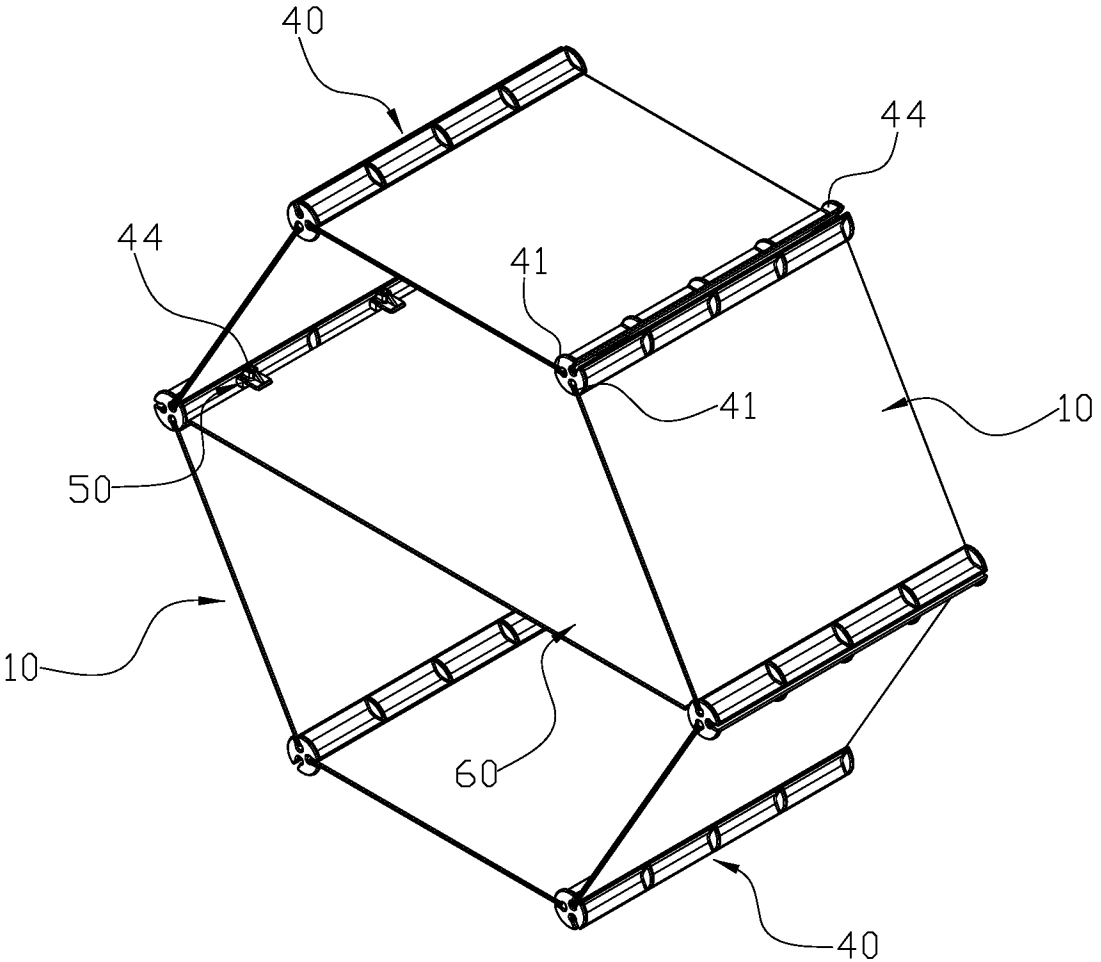
FIG. 8 is a three-dimensional combinational view of the second embodiment of the shelving structure of the present invention.
Figure 9:
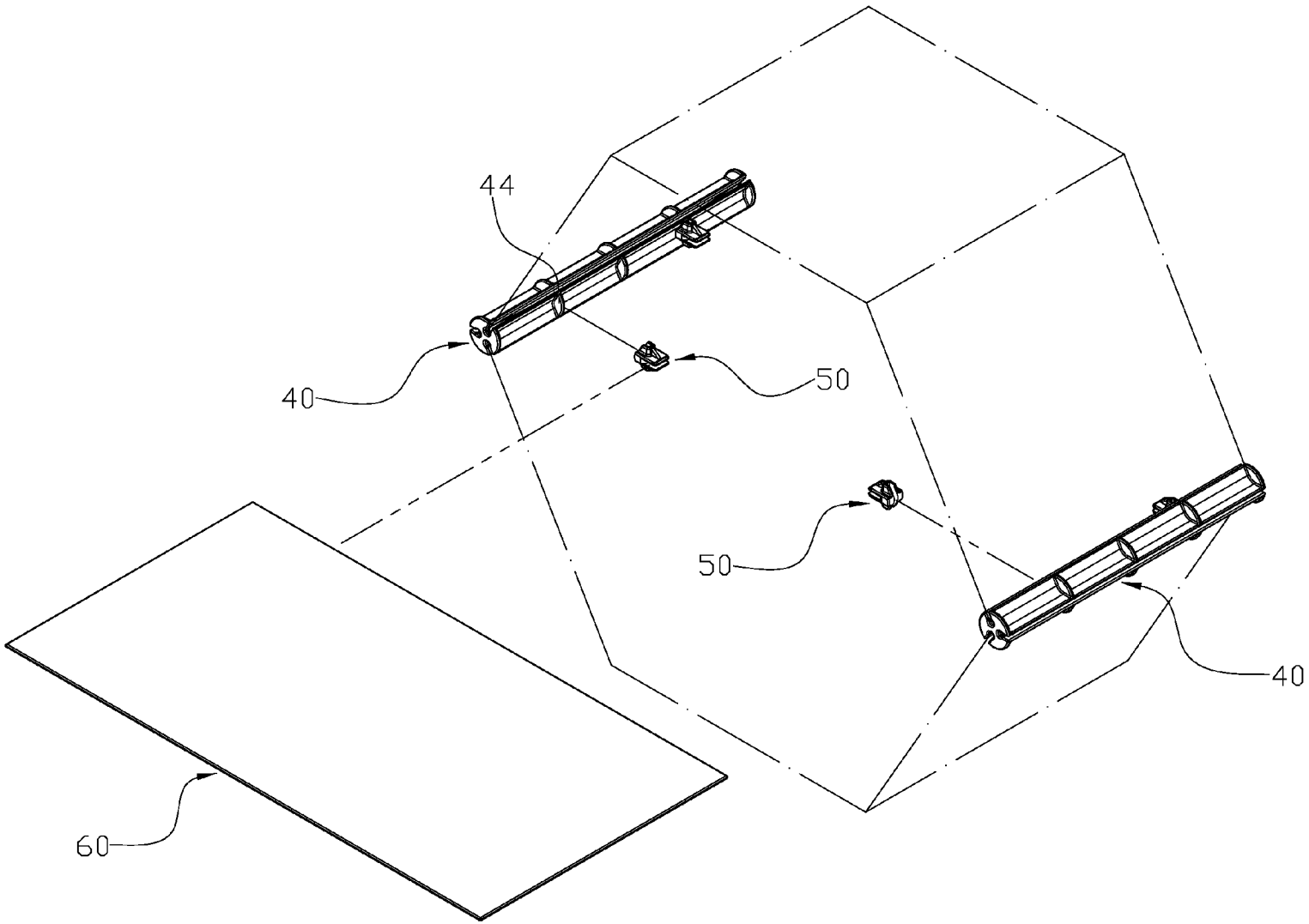
FIG. 9 is an exploded perspective view of the second embodiment of the shelving structure of the present invention.

As illustrated in FIGS. 8 and 9, by using the clipping member (50), the shelving structure of the present invention can support the installation of a dividing plate (60) within its storage space. The clipping member (50) is fixed by one clipping component to the extension plates (44) of the frame member (40), and provides support to the dividing plane (60) by another clipping component that clips to the dividing plane (60).

Figure 10:
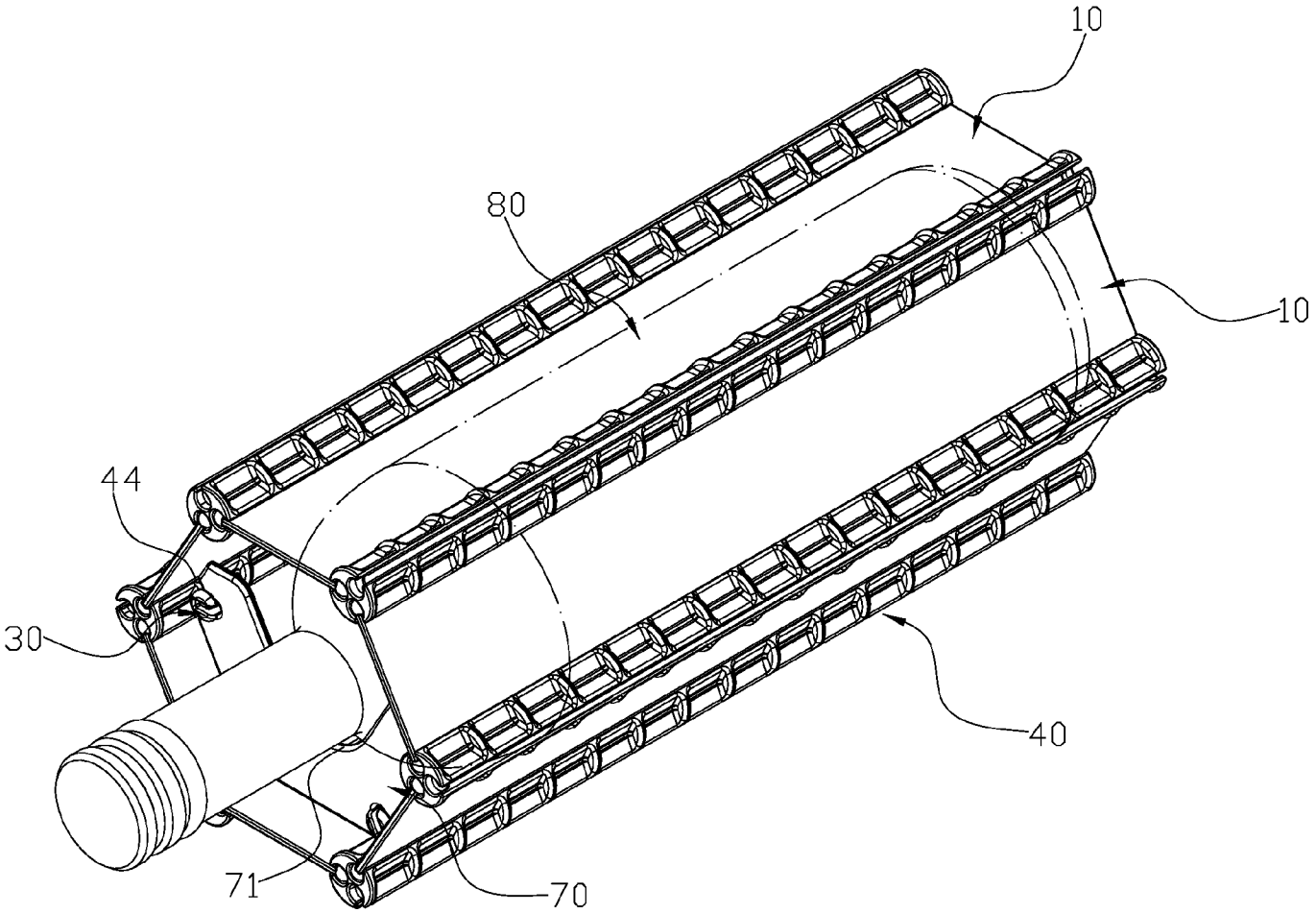
FIG. 10 is a three-dimensional combinational view of the third embodiment of the shelving structure of the present invention.
Figure 11:
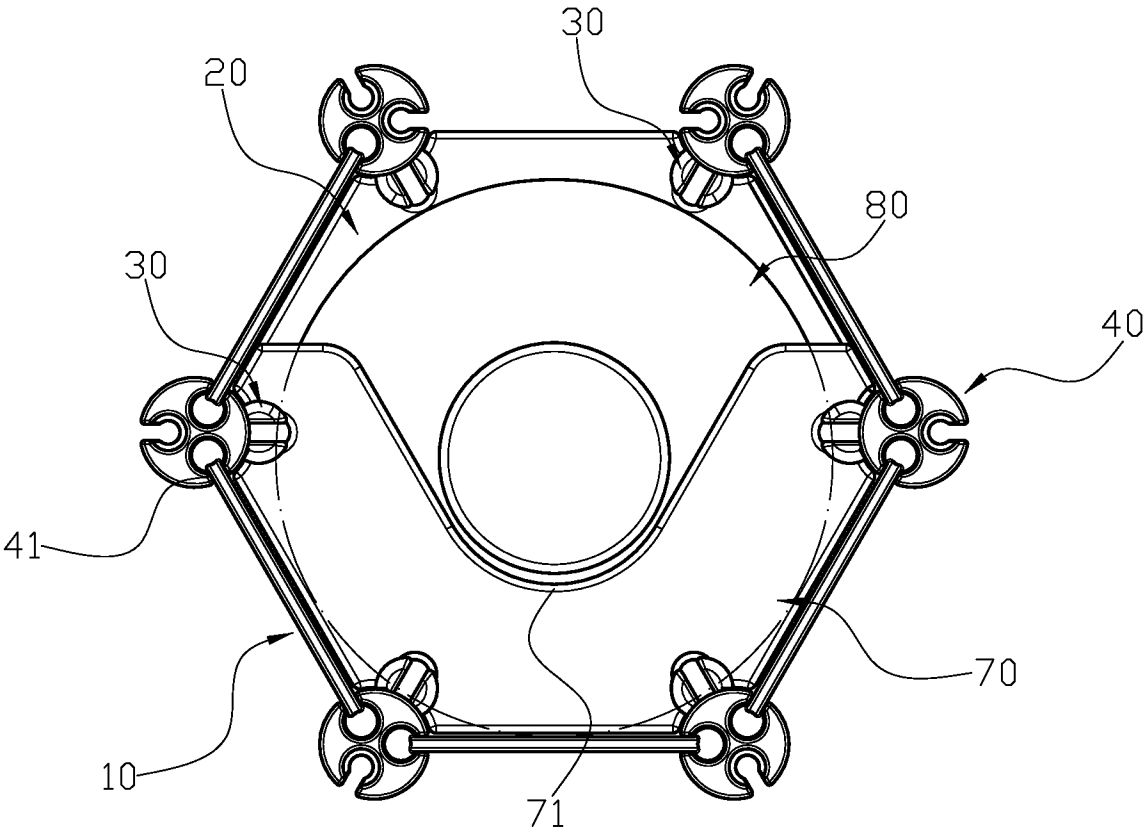
FIG. 11 is a sectional view of the third embodiment of the shelving structure of the present invention.

As illustrated in FIGS. 10 and 11, another specific embodiment of the shelving structure of the present invention can serve as a bottle holder by the further installation of a vertical plate (70). The vertical plate (70) is placed at the front end of the shelving structure and has a "V"-shaped recess (71) on its top side which supports the bottle neck (80). Similar to the rear plate (20), the vertical plate (70) also has U-shaped slots at its four corners corresponding to the locations of the frame members (40). The U-shaped slot also has continuous bounding edges on its both sides; therefore the vertical plate (70) can be connected to the extension plates (44) of the frame member (40) via the connecting member (30).

The shelving structure of the present invention has the following advantages over current shelving structures: (i) The shelving structure of the present invention can be readily uninstalled when not being used, which not only allows convenient handling and transportation, but also dramatically saves storage space; (ii) The shelving structure of the present invention can be conveniently installed without sorting to any tools. In addition, installing this shelving structure does not involve use of any screws since it usually slows down the process of installation; (iii) The building components of the shelving structure of the present invention, the shelf board and the frame member, can be used for constructing shelving structures of various shapes or combinations based on space restrictions or for certain visual effects. This features allows flexible use or rearrangement of the shelving structure based on the available space or the requirement of environment; and (iv) The shelving structure of the present invention can be rearranged into other shapes or forms of structures by modifying the connections among connection members, shelf boards, and bearing boards, thereby allowing the use of this shelving structure for multiple purposes.

The above description and illustrations are for one exemplary embodiment of the present invention and should not be considered to limit the scope of the implementation of the present invention. Accordingly, the present invention is not to be considered as limited by the forgoing description, but includes any equivalents.

What is claimed is:

1. A shelving structure comprising: a predetermined number of shelf boards, rear plates, connecting members and frame members, wherein each said shelf board is a rectangular board, and each said rear plate is a hexagonal board having a U-shaped slot at each corner thereof, and each said U-shaped slot has bounding edges on both sides of said slot; wherein each said connecting member has two clamping planes spaced with a connecting base, and one of the two clamping planes has two bulged ribs; wherein each said frame member has three equally distributed holding slots extending through the frame member longitudinally from a top to a bottom thereof, and each outer surface of the holding slots of the frame member has an elongated recessed portion having regularly spaced extension plates extending outwards perpendicular to the frame member to secure the connecting member with the clamping planes, wherein each of the connecting base is slid into the U-shaped slots of the rear plate with the bulged ribs engaged with the bounding edges of the U-shaped slots, thereby fastening the respective connecting member to the rear plate and achieving a secure connection therebetween, and the frame members are then placed against an arc-shaped recess of the rear plate, and one of the extension plates of the frame members is interposed between the clamping planes of the connecting member, thereby creating the shelving structure.

2. The shelving structure of claim 1, wherein the size of said shelf board is predetermined to allow different size, depth and volume of the shelving structure for storing different items.

3. The shelving structure of claim 1, wherein a dividing plate is installed within the shelving structure, and a clipping member is secured at the extension plate.

4. The shelving structure of claim 1, wherein a vertical plate is secured at the extension plates of the frame member via the connecting member, and the vertical plate has a V-shaped recess to support a bottle by receiving a bottle neck of said bottle at said V-shaped recess.

* * * * *